US005085011A

United States Patent [19]

Smith

[11] Patent Number: 5,085,011

[45] Date of Patent: Feb. 4, 1992

[54] METHOD AND APPARATUS FOR MOUNTING AND FACETING GEMSTONES

[76] Inventor: C. R. Smith, P.O. Box 112, Kennesaw, Ga. 30144

[21] Appl. No.: 422,008

[22] Filed: Oct. 16, 1989

Related U.S. Application Data

[62] Division of Ser. No. 68,528, Jul. 1, 1987, Pat. No. 4,864,778.

[51] Int. Cl.[5] ..... B24B 19/00; B24B 41/06

[52] U.S. Cl. ..... 51/216 LP; 51/229; 51/240 GB; 51/277; 51/283 R; 269/119; 269/307

[58] Field of Search ..... 51/229, 283 R, 240 GB, 51/283, 277, 216 L, 165.72, 220, 221 R, 124 R, 125, 125.5; 269/254.05, 111, 118, 307, 302.1, 119, 121, 289 R, 257

[56] References Cited

U.S. PATENT DOCUMENTS

| | | | |
|---|---|---|---|
| 557,981 | 4/1896 | Evard | 277/0 |
| 1,261,766 | 4/1918 | Challet | 229/0 |
| 1,284,109 | 11/1918 | Hunt | 283/0 |
| 2,109,849 | 3/1938 | Price | 77/5 |
| 2,399,052 | 4/1946 | McCain | 51/277 |
| 2,428,859 | 10/1947 | Turner | 51/125 |
| 2,724,220 | 11/1955 | Shaw | 51/125 |
| 2,950,585 | 8/1960 | Bell | 51/221 R |
| 3,144,737 | 8/1964 | Jaas | 51/185 |
| 3,818,641 | 6/1974 | Long | 51/125.5 |
| 3,959,935 | 6/1976 | Stoppacher | 51/395 |
| 4,240,232 | 12/1980 | Chwae | 51/356 |
| 4,274,232 | 6/1981 | Wylde | 51/358 |
| 4,417,564 | 11/1983 | Lawrence et al. | 125/30 |
| 4,418,500 | 12/1983 | Iholakia et al. | 51/125.5 |
| 4,691,481 | 9/1987 | Souch | 51/277 |
| 4,864,778 | 9/1989 | Smith | 51/283 R |

*Primary Examiner*—Bruce M. Kisliuk
*Assistant Examiner*—John A. Marlott
*Attorney, Agent, or Firm*—Kennedy & Kennedy

[57] ABSTRACT

Apparatus for grinding or polishing flat facets of gemstones comprising a mirror lap wheel base adapted to be mounted to a rotary drive and a lap film adapted to be mounted flushly upon the mirror lap wheel base.

5 Claims, 4 Drawing Sheets

METHOD AND APPARATUS FOR MOUNTING AND FACETING GEMSTONES

REFERENCE TO RELATED APPLICATION

This is a division of U.S. patent application Ser. No. 068,528 filed July 1, 1987 now U.S. Pat. No. 4,864,778.

TECHNICAL FIELD

This invention relates to methods and apparatuses for mounting gemstones to faceting machines and to methods and apparatuses of faceting.

BACKGROUND OF THE INVENTION

Gemstones are today commonly made into finished gems by forming a multitude of small flat facets about the surface of the stone. This is commonly done with a faceting machine as exemplified by that one illustrated in U.S. Pat. No. 3,818,641. These machines have an elongated gemstone holding tool, which is termed a dop or dopstick, to an end of which the stone is secured with an adhesive. The other end of the dop is mounted to orientation apparatus by which the dop may be positioned and held in numerous spacial orientations and elevations relative to a base or rotatable lap wheel. The machines also have means for measuring angular orientations of the dop with regard to x, y and z axes. Many also have means for precisely measuring linear elevations of the dop with respect to the lap wheel. So constructed, a stone may be faceted with the orientation of its dop identified and recorded in a programmed manner.

In the course of faceting stones it sometimes occurs that the stone becomes dislodged from the dop and has to be redopped, i.e. remounted. When this occurs it is essential that the stone be remounted so that its orientation with respect to the dop is as it was before, i.e., with the stone centered along the dop axis with its two major facets oriented normal to that axis. Otherwise, those facets that have already been worked (ground and polished) will be misaligned with those yet to be worked and the facets will not be presented to the machine lap wheel surface parallel thereto. In other cases where a stone is to be repolished or repaired it again becomes essential that the stone be redopped in a precise manner in order that the geometries of the facets are duplicated so that each facet will be placed flushly upon the working lap.

Heretofore, quite complex procedures and systems have been used for redopping such as that disclosed in U.S. Pat. No. 4,417,564. However, since faceting is frequently performed by amateurs with limited financial resources, they typically redop by trial and error. As any amateur faceter well knows, this can be an extremely tedious, time consuming and frustrating procedure since the stone must be precisely oriented in three dimensions.

Accordingly, it is to the provision of apparatuses and methods for mounting gemstones to faceting machines and to improved apparatuses and methods of faceting that alleviates the just described problems that the present invention is primarily directed.

SUMMARY OF THE INVENTION

In one form of the invention apparatus for mounting gemstones to dops comprises an at least partially transparent base that has a flat upper surface which bears a target. Means are provided for centering and holding a gemstone upon the base upper surface over the target with a flat facet of the gemstone verifiably positioned flushly upon the base upper surface and centered over the target by visual reference to an image of the facet through the transparent base. The apparatus also includes means for guiding a dop along an axis oriented normally to the base upper surface in alignment with the target and into contact with a gemstone centered and held by the centering and holding means target flushly upon the upper base surface.

In another form of the invention a method of mounting a gemstone on a dop comprises the steps of placing the gemstones on a transparent support that has a target position, and positioning the gemstone at the targeted position by visual reference to the location of the surface of the stone in direct contact with the transparent support. A dop is then moved along an axis extending from the targeted position onto the gemstone for adherence thereto by an adhesive agent.

In another form of the invention apparatus for grinding or polishing flat facets of gemstones comprises a mirror lap wheel base adapted to be mounted to rotary drive means, and a lap film adapted to be mounted flushly upon the mirror lap wheel base. So constructed, a flat facet to be worked while mounted to a dop of a faceting machine may be placed upon the mirror lap wheel base and a reflected image of the facet observed for verification of flush facet contact with the base. Subsequently, the facet may be worked by the lap film mounted flush to the base.

In yet another form of the invention, a method of grinding or polishing a flat facet of a gemstone comprises the steps of placing the facet upon a mirror lap wheel base, observing the reflected image of the facet, and orienting the gemstone as needed until the reflected image is substantially that of the entire facet at a determined gemstone orientation thereby verifying flush contact being established between the flat facet and the mirror lap wheel base. The gemstone is then removed from the mirrored lap wheel base and a lap film mounted flushly upon the mirrored lap wheel base. The lap film covered base is then driven and the gemstone facet brought into working engagement with the rotating film covered base with the facet substantially at the determined orientation.

DETAILED DESCRIPTION

Figure 1:
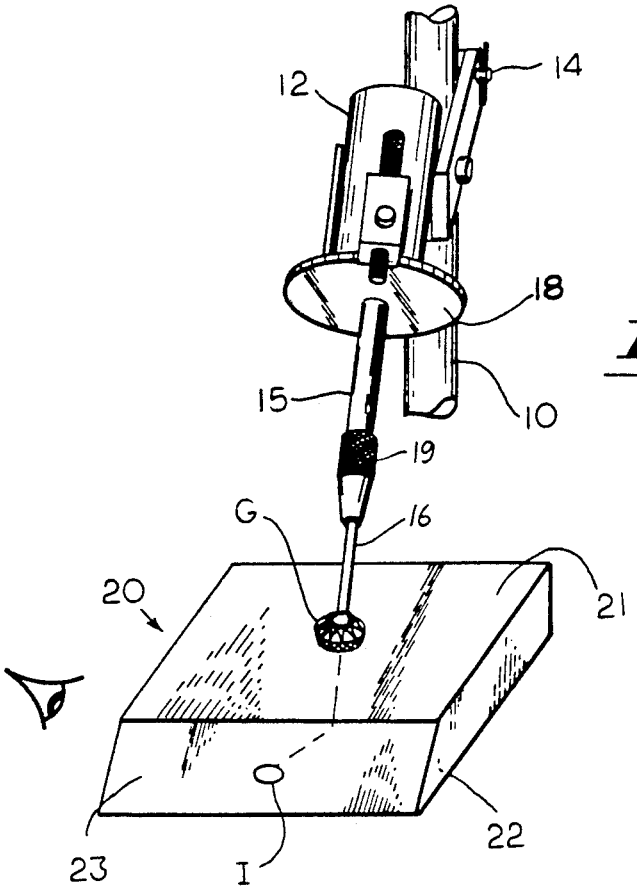
FIG. 1 is a perspective view of a portion of a faceting machine that includes a dop to which a gemstone is shown to be mounted and in contact with a base element of a component of apparatus of the present invention.
Figure 6:
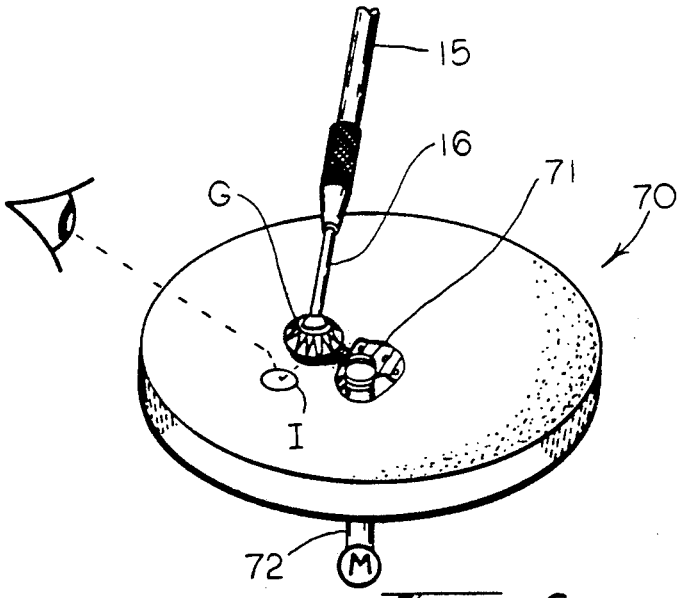
FIG. 6 is a perspective view of the apparatus partially illustrated in FIG. 5.

With reference next to FIG. 1, there is shown a portion of a faceting machine which has a track 10 that extends upwardly from an unshown base which rotatably supports a lap or lap wheel such as that shown in FIG. 6. The track 10 supports a tiltable frame 12 whose elevation may be finely adjusted above the lap and held in position by a set screw 14. The faceting apparatus is conventional and therefore all of its various indexing and orientation means are not shown or discussed, for clarity of explanation. The faceting machine also has a shaft or spindle 15 that extends downwardly from an index gear 18 mounted to the frame. A dop or dopstick 16 extends coaxially from the shaft 15 and is releasibly held thereto by a quill 19. The faceting machine dop 16 may thus be raised and lowered and oriented in x, y and z planes and its various position and orientations recorded in faceting a gemstone G mounted with an adhesive to the dop end.

With continued reference to FIG. 1 the faceting machine is shown holding a gemstone G with one of its flat surfaces or facets flush upon an upper surface 21 of a transparent base 20 which is a component of gemstone mounting apparatus of the present invention. The base has a mirror functioning bottom surface 22 (coated or noncoated) located parallel with the top surface 21 and a beveled front surface 23. Thus, with the gemstone G positioned with one of its flat facets in flush, direct contact with the upper surface of the base 20, an image I of that facet may be visually observed reflected off of the bottom surface 22 of the base. Here, the image I is oval indicating that an entire surface of an oval facet is indeed in direct contact with the base. Should, however, a flush engagement of the flat facet not be had, only a portion of the facet would be observed. That this phenomenon occurs may be easily confirmed in actual practice. In that case the faceter would know that he or she must reorient the stone in order to have the flat facet properly oriented parallel with the upper surface 21 of the base. As will be explained in more detail later, it is important to achieve flush engagement with the base so that the surface of the facet may be visually confirmed as being actually parallel with the upper surface of the base.

Figure 2:
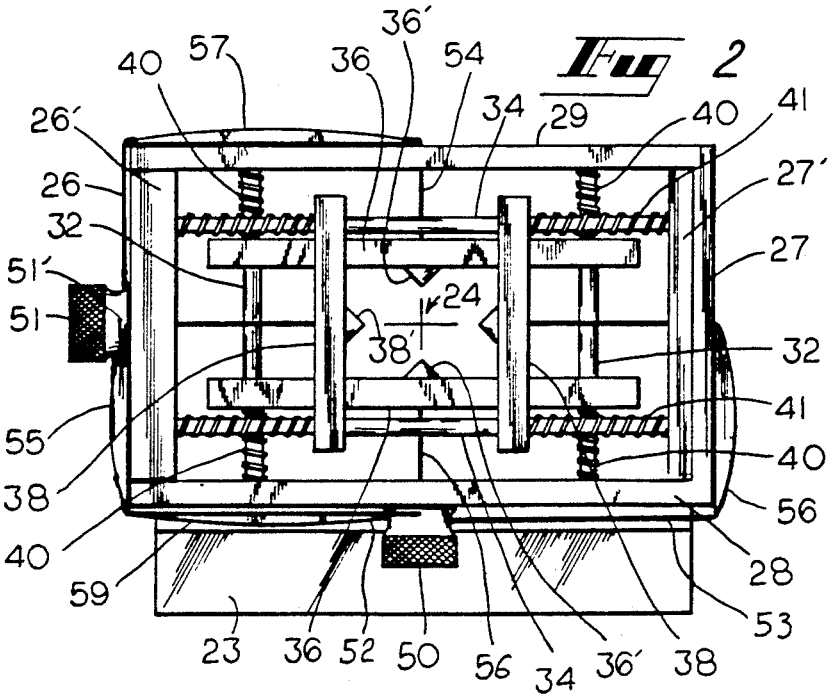
FIG. 2 is a plan view of apparatus for mounting gemstones to dops in a preferred form with its lid component removed.
Figure 3:
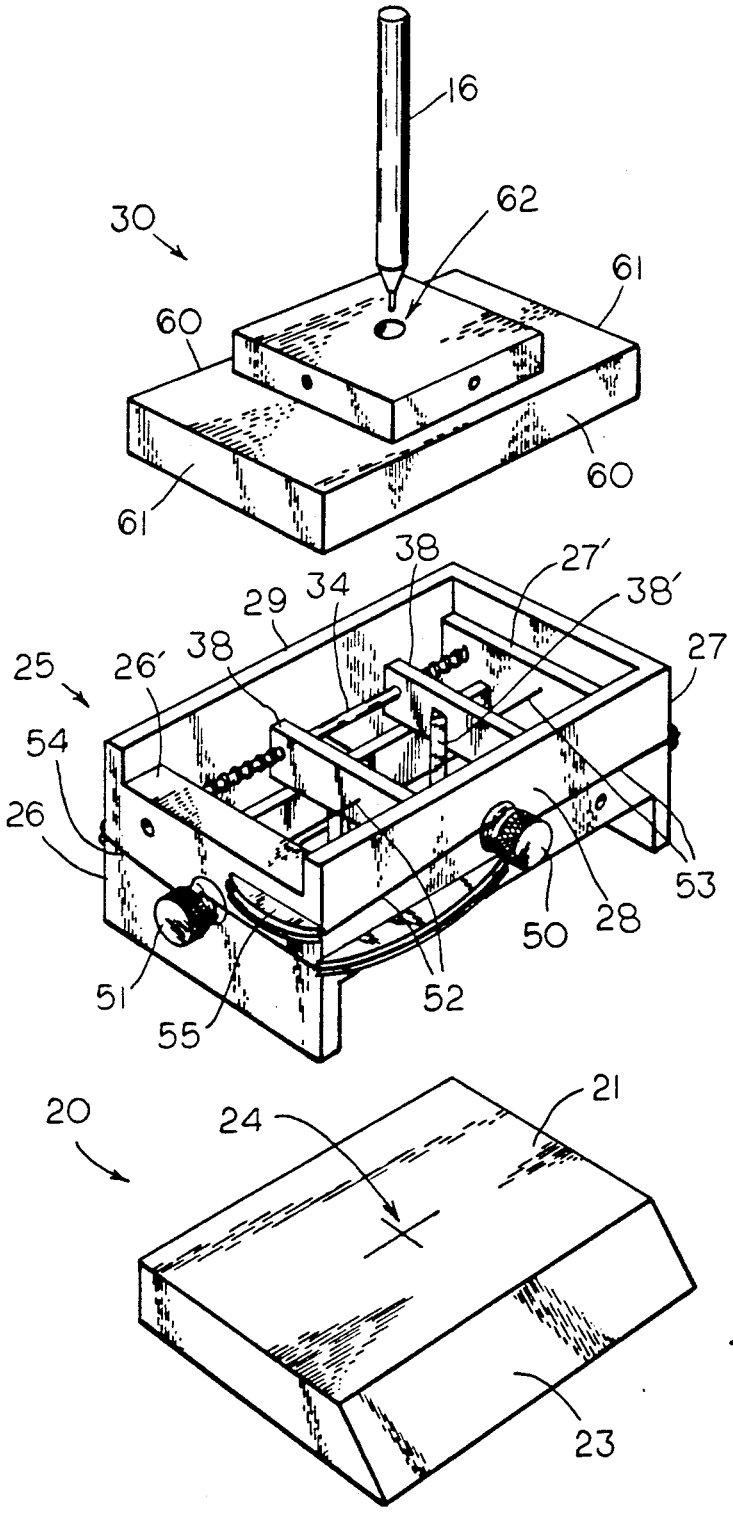
FIG. 3 is an exploded view of the apparatus illustrated in FIG. 2 together with the lid.

With reference next to FIGS. 2 and 3 the gemstone mounting apparatus is seen to include three components, namely the just described base 20 plus a stone positioning and holding module 25, and a lid 30. With no gemstone present in FIGS. 2 and 3, the base upper surface 21 is seen to bear central location x-y axis target indicia 24 or cross hairs. The centering and holding module 25 is seen to comprise a rectangular frame having opposed sides 26 and 27 which are conjoined right angularly with two other, opposed sides 28 and 29. These sides are dimensioned so that lower portions of three of them may be placed snugly about the sides of the base 20. They may also be provided with set screws to hold the two components together. The side 27 is stepped so as to have a ledge 27'. Side 26 also has a ledge 26' that is coplanar with the ledge 27'. A pair of rails 32 is mounted so as to extend between the sides 28 and 29. Similarly, another pair of rails 32 extends between the sides 26 and 27 above the rails 32. A pair of positioning and gripping bars 36 is mounted for movement along the rails 32. Similarly, another pair of positioning and gripping bars 38 is movably mounted to the rails 34 above the bars 36. The bars 36 are provided with elongated, wedge-shaped projections 36' aligned with one of the cross hairs of the target 24. Similarly, the bars 38 are provided with wedge-shaped projections 38' aligned with the other cross hair of the target 24. The projections 38' depend downwardly beneath the bars 38 themselves, as may be seen in FIG. 3. The bars 36 are biased away from the sides 28 and 29 toward the target 24 by compression springs 40 mounted upon the rails 32 between the bars and the sides 28 and 29. The bars 38 are also spring biased toward the target 24 by compression springs 41 mounted upon the rails 34. With this construction it is seen that the bars 36 and 38, unless otherwise restrained, are spring biased to bring their wedge-shaped projections 36' and 38' above and into mutual contact alignment over and with the center of the target 24.

With continued reference to FIGS. 2 and 3, the positioning and holding or gripping module 25 is further seen to have a knurled knob 50 rotatably mounted centrally to the side 28 aligned with one hair of the target 24 and another knurled knob 51 rotatably mounted to the side 26 and also aligned with the other hair of the target 24. A flexible wire 52 extends from a capstan portion of the knob 50 over the outside of side 28 and then over an arcuate guide 55 that projects outwardly from wall 26 and in through an unshown channel in the wall 26 formed in alignment with the target 24 to terminate at one of the bars 38. Another flexible wire 53 extends from that portion of the capstan of the knob 50 located diametrically opposite the point at which the wire 52 is attached to it over another portion of the outside of side 28, around a guide 56 through another aligned hole in side 27 to terminate at the other bar 38. Similarly, a flexible wire 54 extends from a capstan portion 51 of knob 51' of the knob 51 over another guide 57 that projects outwardly from the sidewall 29 to bar 36 aligned with the target 24. Yet another wire 56 extends from the capstan portion 51' of knob 51 to the other guide bar 36 over another guide 59 mounted to the outside of wall 28. With this arrangement a manual twisting of the knob 50 causes the bars 38 to move in unison either towards or away from the target 24. A twisting of the knob 51 causes the bars 36 to move in unison either towards or away from the target 24. Each knob is preferably provided with unshown detents so that the bars may be temporarily held in a spread position spaced from the target.

With continued reference to FIG. 3 the apparatus is further seen to include a lid 30 which is of a generally stepped, box or slab shape. The lid has two opposed, mutually parallel sides 60 and two other opposed, mutually parallel sides 61 that are conjoined with the sides 60 at four corners. The lid is provided with a cylindrical channel 62 through its center which is sized to receive the dop of dopstick 16 shown in FIG. 1 in sliding, frictional engagement. The sides of the lid 30 are dimensioned so that the lid may be placed within an upper portion of the positioning module 25 with walls 60 flush against the surfaces of the walls 28 and 29 and with one of the lid sides 61 flush against the inside of the side 27. When this is done the lid rests upon the ledges 26' and 27'. In this position the channel 62 in the lid is in axial alignment with the target 24 on the base whenever the module 25 is mounted to the base.

With reference next to FIG. 4, the manner in which a gemstone G may be mounted to a dop 16 in accordance with the method of the invention, utilizing the apparatus of the invention, is sequentially illustrated in diagrammatical form. The positioning and holding module 25 is mounted securely to the base 20 with the lid 30 removed. The knobs 50 and 51 are twisted so as to draw the bars 36 and 38 apart and away from the target 24, as shown in FIG. 4A where they ar held by the detent mechanism. Gemstone G is then manually placed upon the upper surface 21 of the base 23 adjacent the target 24, as shown in FIG. 4A. The knobs 50 and 51 are then released and allowed to be moved by the springs 40 and 41 gradually towards the target. As this occurs their wedge shaped portions 36' and 38' contact the girdle of the gemstone G. In FIG. 4A the gemstone G is seen to be to the left of the axis that extends vertically through the center of the target 24. The left bar wedge 38' will then first contact the left side of the stone, as viewed here, thereby sliding it towards the target as indicated by the arrow. Similarly, one of the bars 36 may first engage the girdle of the stone to urge it towards the other center line of the target area. In this manner the stone will be moved by the two sets of bars 36 and 38 to a position centered over the cross-haired target with its bottom flat facet flush upon the upper surface and target of the base 20, as shown in FIG. 4B. That the stone is centered over the target may be verified by observation of the image I of the facet located upon the base, as shown in FIG. 1.

Figure 4A:
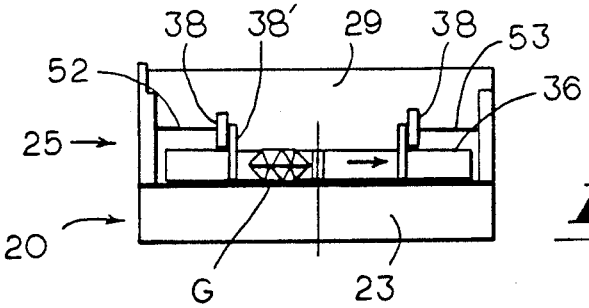
FIG. 4 diagrammatically illustrates a sequence steps followed in utilizing the apparatus of FIGS. 1–3 in practicing a method of the invention.
Figure 4B:
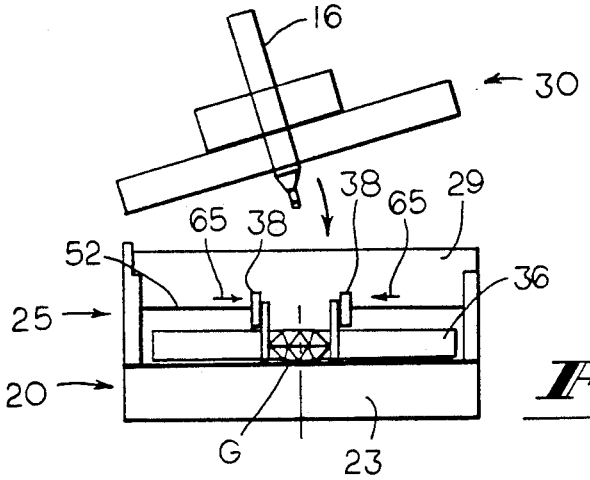
Figure 4C:
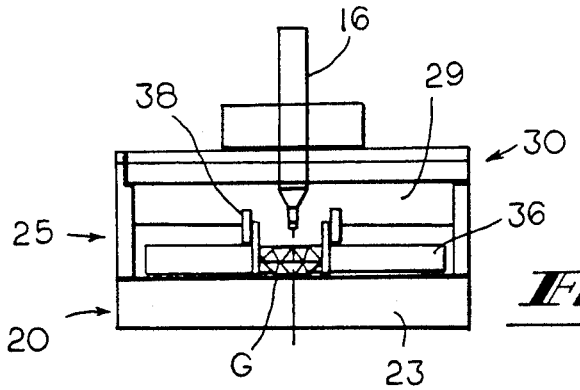
Figure 4D:
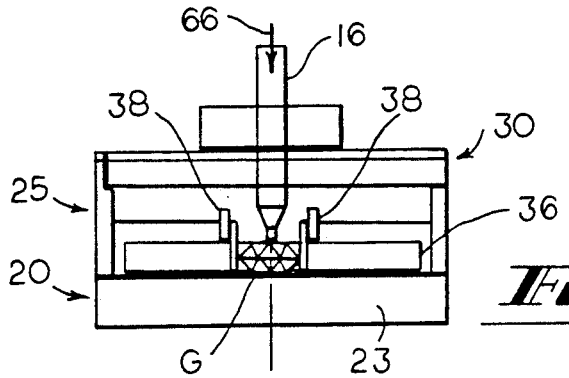

The lid 30 is now placed upon the module 25 with a dop slidably mounted within channel 62. Preferably, adhesive material is placed on the lower tip of the dop. However, if desired the adhesive may instead be placed upon the upper surface of the gemstone. Once this is done as shown in FIG. 4C, the dop 16 is aligned with the center of the gemstone G which itself is centered over the target 24. The dop 16 may then be pushed downwardly, as shown by arrow 66, bringing the adhesive coating dop tip into contact with the gemstone. Once the adhesive has set the lid may be removed and the dopstick pushed completely through the channel 62 and off of the lid with the stone G properly mounted to it.

Where the faceting machine is equipped with fine dop height adjustment and recording, the base 20 may be set upon its grinding or polishing lap wheel and there used to verify a parallel relation of facet to lap by observing the image I being flush upon the base surface 21. The stone may then be lifted by the dop, the base removed, and the stone then worked upon the lap by lowering it any vertical distance of lift plus the height of the base 20. Alternatively, a mirror type lap wheel may be employed as next explained.

Figure 5:
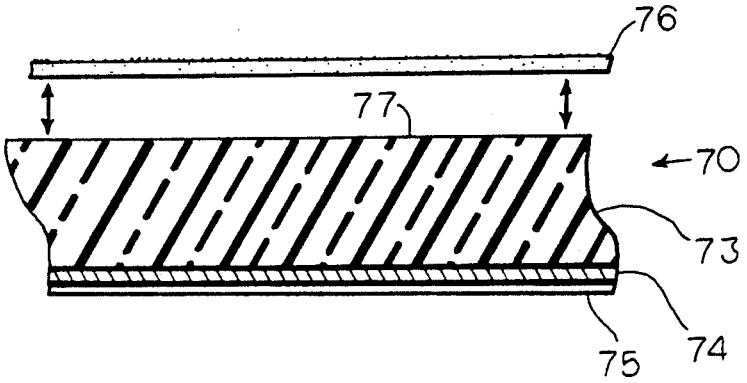
FIG. 5 is a partially exploded, fragmentary view, in cross-section of apparatus for grinding and polishing flat facets of gemstones in accordance with the invention.

In FIGS. 5 and 6 the principle of being able to observe and confirm flush engagement of a flat facet with a surface of a mirror is applied directly to the lapping operation itself. Here, a mirrored lap wheel, indicated generally at 70, is seen to have its bottom formed with a threaded hole 71 into which a drive shaft 72 coupled with a motor M may be threaded for rotating the lap. As shown in greatly enlarged detail in FIG. 5, the lap wheel 70 has a transparent portion 73 which is preferably made of a clear, hard plastic. The bottom surface of the transparent portion is silver coated or tinned with a coating 74 that provides a reflective surface. A protective coating 75, as of an epoxy, is applied to the other side of the mirror coating 74. A lap film 76, such as an imperial diamond lapping film sold by the 3M Corporation, is provided to be mounted flush atop the upper surface 77 of the transparent portion 73 of the lap and held thereto as with a wetting agent such as water.

In using the apparatus of FIGS. 5 and 6 the lap film 76 is removed from the lap and a gemstone G mounted that is on the end of a dopstick 16 and is placed upon the surface 77. Since the lap functions as a mirror, verification may be optically made by viewing an image I of the flat facet that is in flush contact with the surface 77. In the event that the facet is not flush only a portion of its surface is observed whereupon the gemstone is repositioned so that the facet is flush. When flush engagement is made and verified the stone is temporarily removed and the film 76 then placed flush upon surface 77. By returning the stone to its previous position the facet is brought into contact with the working surface of the lap film 76 properly oriented so that it is ground or polished at an angle that is not skewed with respect to the facet.

It thus is seen that apparatuses and methods are now provided for mounting gemstones to faceting machines and for faceting that overcome problems long associated with those apparatuses and methods of the prior art. It should be understood, however, that the just described embodiments merely illustrate principles of the invention in preferred forms. Many modifications, additions and deletions may therefore be made without departure from the spirit and scope of the invention as set forth in the following claims.

I claim:

1. Apparatus for grinding or polishing flat facets of gemstones comprising, in combination, a mirror lap wheel base having mounting means for mounting the wheel base to rotary drive means, and a lap film adapted to be mounted flushly upon said mirror lap wheel base, whereby a flat facet to be worked while mounted to a dop of a faceting machine may be placed upon the mirror lap wheel base and a reflected image of the facet observed for verification of flush contact with the base and subsequently worked by the lap film mounted flush to the base.

2. A method of grinding or polishing a flat facet of a gemstone comprising the steps of placing the facet upon a mirror lap wheel base, observing the reflected image of the facet, orienting the gemstone as needed until the reflected image is substantially that of the entire facet at a determined orientation thereby verifying flush contact being established between the entire facet and the mirror lap wheel base, removing the gemstone from the mirrored lap wheel base, mounting a lap film flushly upon the mirrored lap wheel base, rotating the lap film covered base, and bringing the gemstone facet into working engagement with the rotating film covered base with the facet substantially at the determined orientation.

3. A lap wheel base for use in grinding or polishing flat facets and which comprises a generally disc-shaped mirror having an axis of rotation and a flat support surface and means for mounting said mirror along said axis to a rotary drive device, whereby a workpiece facet may be placed upon the mirror flat support surface and its degree of flush engagement with the support surface visually observed and the facet then ground or polished with a grinding or polishing material mounted upon the mirror support surface with the base rotated by a rotary drive device.

4. The lap wheel base of claim 3 in combination with a lap film mounted directly upon said mirror support surface.

5. The lap wheel base of claim 3 wherein said disc-shaped mirror has a transparent portion one surface of which is coated with a reflective material and the opposite surface of which is said support surface.

* * * * *